US005121507A

United States Patent [19]

Brown

[11] Patent Number: 5,121,507

[45] Date of Patent: Jun. 16, 1992

[54] HEADWEAR ACCESSORY ATTACHMENT

[76] Inventor: Ronald R. Brown, 16751 Crystal Glade, San Antonio, Tex. 78247

[21] Appl. No.: 595,142

[22] Filed: Oct. 10, 1990

[51] Int. Cl.[5] ..... A42B 1/06

[52] U.S. Cl. ..... 2/199; 2/10; 2/172

[58] Field of Search ..... 2/199, 10, 171, 172, 2/185 R, 196, 206, 207, 209.1, 422, 425

[56] References Cited

U.S. PATENT DOCUMENTS

| | | | |
|---|---|---|---|
| 270,242 | 1/1883 | Mitchell | 2/199 |
| 822,986 | 6/1906 | Rochet | 2/172 |
| 899,334 | 9/1908 | Seitzman | 2/172 |
| 1,202,513 | 10/1916 | Gudger | 2/10 |
| 1,228,341 | 5/1917 | Maynard | 2/10 |
| 1,665,513 | 4/1928 | Thomas | 2/10 |
| 1,725,340 | 8/1929 | Castriotis | 2/10 |
| 1,764,500 | 6/1930 | Blakesley | 2/10 |
| 1,857,284 | 5/1932 | Nelson | 2/10 |
| 2,442,825 | 6/1948 | Rabushka | 2/199 |
| 2,986,741 | 6/1961 | Brasington | 2/172 |
| 3,016,545 | 1/1962 | Donahue | 2/199 |
| 3,671,974 | 6/1972 | Sims | 2/425 |
| 4,063,740 | 12/1977 | Mader | 2/185 R |
| 4,268,918 | 5/1981 | Lee | 2/199 |
| 4,304,005 | 12/1981 | Danley | 2/199 |
| 4,545,313 | 10/1985 | Chaing | 2/199 |
| 4,821,341 | 4/1989 | Baptiste | 2/199 |
| 4,961,232 | 10/1990 | Hulsey | 2/206 |
| 4,980,928 | 1/1991 | Ellis | 2/185 R |
| 5,046,195 | 9/1991 | Koritan | 2/172 |

FOREIGN PATENT DOCUMENTS

| | | | |
|---|---|---|---|
| 602605 | 3/1926 | France | 2/10 |
| 1377550 | 2/1965 | France | 2/199 |
| 1562082 | 4/1969 | France | 2/199 |

*Primary Examiner*—Werner H. Schroeder
*Assistant Examiner*—Diana L. Biefeld

[57] ABSTRACT

An accessory (10) that can be connected to, and detached from, various forms of headwear comprising a means of attaching units (20) such that the accessory (10) and the headwear forms a continuous surface. Such a continuous surface increases coverage to the neck and ear areas.

1 Claim, 2 Drawing Sheets

HEADWEAR ACCESSORY ATTACHMENT

BACKGROUND

1. Field of Invention

This invention relates in general to headwear, and in particular to an accessory that can be attached, detached, and interchanged with various forms of headwear.

2. Description of Prior Art

A large percentage of people are engaged in some form of outside activity. These activities include labor, recreational, and a combination of both. As we engage in outside activity, we are exposed to the many elements of nature—sunshine, wind, rain, snow, etc. These elements have a direct effect on the human body. Precautions are taken to lessen the effect of these natural elements. Exposure to the sun has become more critical due to the depletion of the ozone layers.

Our safeguards against the sun's rays, above the shoulders, include protection creams, sunglasses, and various types of headwear such as hats, caps, and visors. The areas we physically fail to protect are our neck and ears. There are forms of caps that include a permanent flap or flaps located in the back of the cap. The coverage provided by the flap(s) is restricted to the neck area and does not provide coverage to the ears. Some caps, include a permanently affixed optional covering for the ear areas, but do not provide adequate coverage for the back of the neck area. There are caps that provide coverage to the ear and rear neck areas, but the panel that offers this covering is permanently attached to the cap. There are hard hats that utilize an attaching accessory and offers coverage to the ear and rear neck areas, but the accessory is restricted in that it only adapts to the hard hat for which it was designed. This invention provides an attachable and detachable accessory to various forms of headwear that offers coverage to the ears and to the back of the neck, and is interchangeable with other forms of headwear.

OBJECTS AND ADVANTAGES

Accordingly, several objects and advantages of my invention are:

(a) to provide a headwear accessory that comprises a means of attachment to certain forms of headwear such that a continuous surface is formed by the headwear and the headwear accessory which allows for increased coverage to the ear and neck areas;

(b) to provide a headwear accessory that comprises a means of detachment after it has been attached to an accommodating form of headwear; and (c) to provide a headwear accessory that can be interchanged with other forms of headwear.

Still further objects and advantages will become apparent from a consideration of the drawings and ensuing description of it.

DRAWING FIGURES

DESCRIPTION

FIGS. 1 to 8

Figure 1:
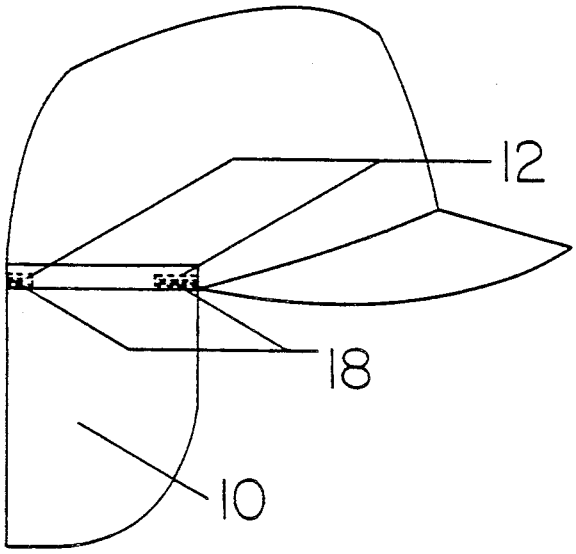
FIG. 1 is a side view showing the headwear accessory attached to a cap.

Referring to FIG. 1, an overall drawing of a preferred embodiment of the invention is shown. In this embodiment, a headwear accessory 10 has been attached to the sides of the attachment units that have been attached to sides of a cap.

Figure 2:
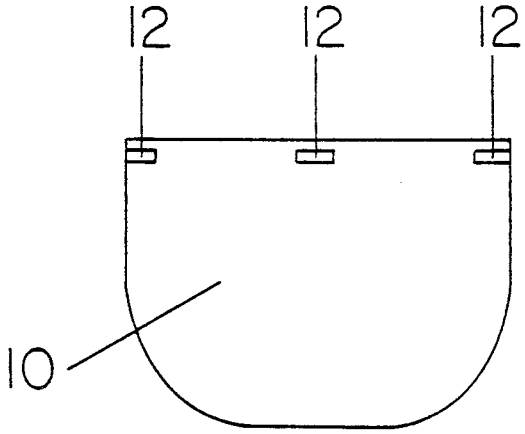
FIG. 2 is headwear accessory pattern in accordance with the present invention.

FIG. 2 shows a preferred embodiment of material 10. There are contact points 12 located at equally spaced distances from and including the top center of material 10. The contact points are comprised of felt-like material, and are sewn to the material 10.

Each contact point has a corresponding and separate attachment unit. This unit is shown in the form of a plastic clip 20 in FIG. 3. The outer surface 16 is comprised of a surface that has been bonded to the back surface of a patch of material mounting plurality of small hook like members 18. Such material is sold under the trademark "VELCRO".

Figure 4:
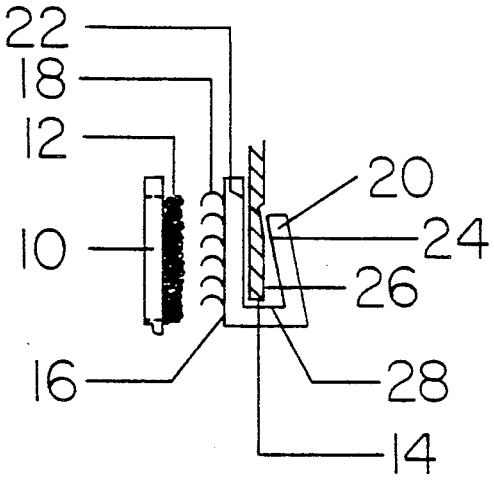
FIG. 4 is a sectional view of the side of a cap inserted into the headwear attachment unit facing a side view of the top portion of the headwear accessory pattern.

A channel 26 is formed by the side 22, side 24, and side 28 of the plastic clip 20. The shape of channel 26 will result in a binding grasp on the headwear as shown in FIG. 4. The space between side 22 and side 24 will allow for movement of clip 20 to a preferred location.

Additional embodiments are shown in FIGS. 5, 6, 7, and 8. In each case, the headwear accessory has been altered in design and composition. The contact points 12 of each accessory remain in their original positions, FIG. 2, and each has their corresponding attachment unit 20, FIG. 3.

Figure 5:
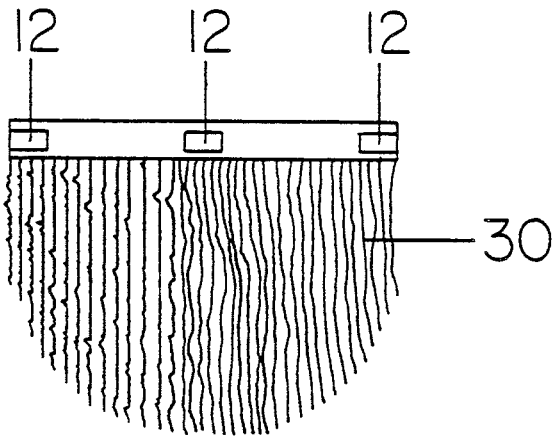
FIG. 5 is a headwear accessory altered in design to simulate strands of hair.

FIG. 5 shows a headwear accessory embodiment 30 that is comprised of strands of material that may be comprised of fabric, non-fabric, or a combination of fabric and non-fabric.

Figure 6:
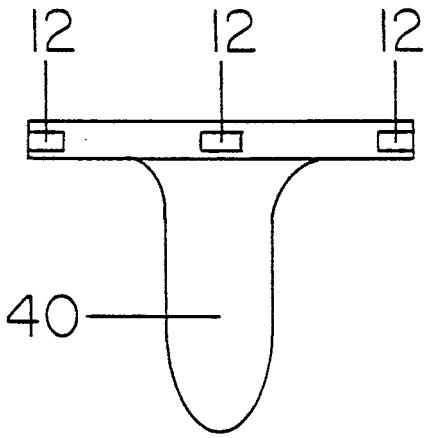
FIG. 6 is a headwear accessory altered in design to simulate the tail of an animal.

FIG. 6 shows a headwear accessory embodiment 40 that is comprised of a design which resembles an animal's tail. The material used in this design may be fabric, non-fabric, or a combination of fabric and non-fabric.

Figure 7:
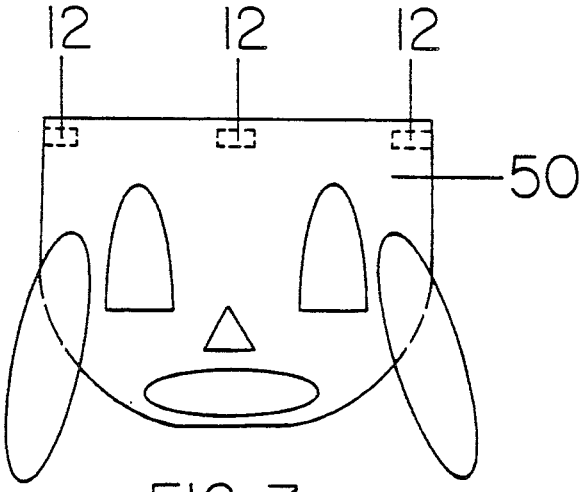
FIG. 7 is a headwear accessory altered in design to simulate facial features.

FIG. 7 shows a headwear accessory embodiment 50 that is comprised of facial characteristics. The characteristics are comprised of animal or human features. The material used in this design may be fabric, non-fabric, or a combination of fabric and non-fabric.

Figure 8:
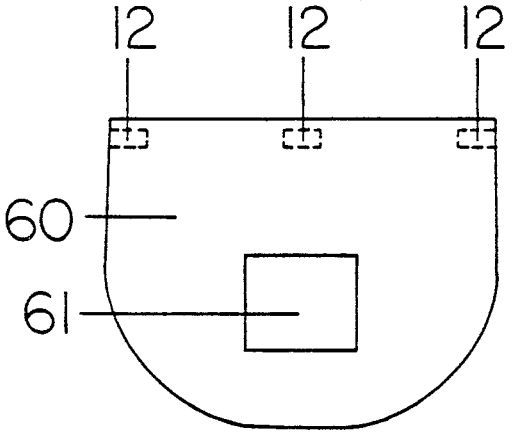
FIG. 8 is a headwear accessory altered in design to include pocket(s).

FIG. 8 shows a headwear accessory embodiment 60 that is comprised of added material 61 to form a pocket. The pocket can be of a design where the pocket remains open at all times. Another design would be where the pocket could be opened and closed using a fastening means. The material used in this design may be fabric, non-fabric, or a combination of fabric and non-fabric.

FIGS. 2, 3, 4

The clips 20 are attached to accommodating forms of headwear by inserting the under side edge 14 of the headwear into channel 26, between side 22 and side 24, FIG. 4. Side 16 of clip 20 faces to the outside of the headwear as shown in FIG. 4.

The under side edge 14 is positioned against side 28 of clip 20. Clip 20 has the ability to slide along the under side edge of the headwear to a preferred location for sizing purposes. The remaining clip(s) follow the above procedure for attachment to the headwear.

Figure 3:
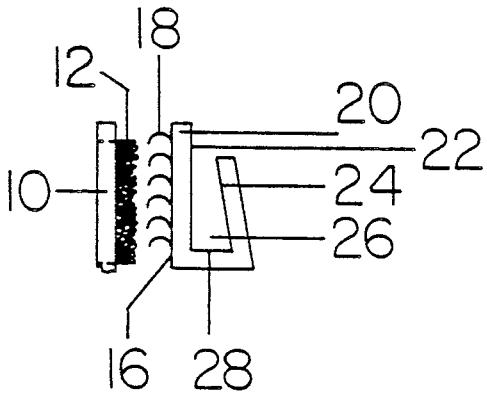
FIG. 3 is a side view of the top portion of the headwear accessory pattern facing a side view of the headwear attachment unit.

The clips 20 have been positioned on the headwear and are now ready for the attachment of material 10, FIG. 2. This is accomplished by aligning the contact points 12 of material 10 to the contact points 18 of clip(s) 20 so they face each other as shown in FIGS. 3 and 4. The cooperating surfaces of the contact points 12 and 18 are engaged and forms a bond that produces an extension to the headwear. This extension provides increased coverage to the neck and ear areas.

The material 10 may be removed by disengaging the contact points 12 from the contact points 18. This will result in clip(s) 20 still attached to the headwear. An alternative to removing the material 10 from the headwear is to remove the clip(s) 20 from the headwear with the material 10 still intact.

The design of the clip(s) 20 allows them to be attached in an inverted manner. This inverted position increases the types of headwear that can utilize the headwear accessory attachment.

SUMMARY , RAMIFICATIONS, AND SCOPE

Accordingly, the reader will see that the headwear accessory attachment of this invention can be easily attached, detached, and interchanged with various forms of headwear. In addition, it offers increased coverage to the ear and neck areas. Furthermore, the headwear accessory attachement has the additional advantages in that it can be sold separate and can be attached to already purchased headwear;

it has year around applications to combat the forces of nature, thus providing health benefits;

it can be detached from the headwear and used as a rag or towel;

it can be designed such that color coordination can provide safety benefits; it allows a jogger or a highway worker to give notice of his/her presence thus providing an awareness and caution to others;

it can be utilized as an advertising medium in that it can be silkscreened or monogrammed; it allows an individual to declare his/her identity by placing the name(s) of athletic teams, logos, business names, promotional names, and individual names on one side.

The foregoing description of the preferred embodiments of the invention has been presented for the purposes of illustration and description. It is not intended to be exhaustive or limit the invention to the precise form disclosed. Many modifications and variations are possible in light of the above teaching. It is intended that the scope of the invention be limited not by this detailed description but rather by the claims appended hereto.

I claim:

1. An accessory attachment for a headware having a rearwardly disposed generally vertical rim portion extending around the rear portions of the headware when applied to the head of a wearer, comprising, in combination:

a plurality of U-shaped clips frictionally encompassing said rim portion and being positionable thereon in a plurality of selected peripherally spaced positions;

each said clip having a patch of hooked locking fibers secured to the outwardly facing surface of the clip;

an accessory attachment formed of flexible material and having a band formed on its upper end; and a plurality of patches of fibrous material secured to said band in the same spaced relationship as said clips, whereby said accessory attachment may be detachably secured to said locking fibers on said clips.

* * * * *